United States Patent [19]

Kuzyk et al.

[11] Patent Number: 4,461,555

[45] Date of Patent: Jul. 24, 1984

[54] METHOD AND APPARATUS FOR PROCESSING AND DRYING PHOTOGRAPHIC DISC FILM

[76] Inventors: Roman Kuzyk, 55 Florister Dr., Hamilton Square, N.J. 08690; William P. Zupko, 144 Edmund St., Trenton, N.J. 08610

[21] Appl. No.: 477,865

[22] Filed: Mar. 23, 1983

[51] Int. Cl.[3] ..... G03D 3/04

[52] U.S. Cl. ..... 354/299; 354/312; 354/323; 354/330

[58] Field of Search ..... 354/299, 307, 310, 311, 354/312, 315, 316, 320, 321, 322, 323, 330; 310/105

[56] References Cited

U.S. PATENT DOCUMENTS

| | | | |
|---|---|---|---|
| 4,178,091 | 12/1979 | Solomon | 354/323 |
| 4,429,980 | 2/1984 | Miller | 354/330 |
| 4,431,294 | 2/1984 | Baker | 354/330 |

*Primary Examiner*—A. A. Mathews

*Attorney, Agent, or Firm*—Martha G. Pugh

[57] ABSTRACT

This discloses and claims a method and apparatus for combining the drying of photographic disc films in the same chamber with the wet processing of the disc film. This includes magnetic coupling means connected to which is a magnetic sensing device which operates to facilitate automatic recoupling when the magnetic means is decoupled. The combination also includes an absorbent liner in the top of the processing chamber for absorbing excess processing liquid, thereby preventing it from dropping on the disc film during the drying process.

7 Claims, 2 Drawing Figures

METHOD AND APPARATUS FOR PROCESSING AND DRYING PHOTOGRAPHIC DISC FILM

BACKGROUND OF THE INVENTION

This relates in general to a method and apparatus for the processing of disc film and more particularly to a method and apparatus for combining the processing and drying function of photographic disc film in a single unit.

In the recently developed prior art of photographic disc processing, it has been customary to have a separate unit for processing and drying. It is therefore an object of the present invention to provide a method and apparatus which combines these two functions, providing a simple, gearless mechanism, which is quieter and more efficient than those of the prior art, which does not require shafts and seals which pass through the walls of the photographic processing chamber.

These and other objects are realized in accordance with the present invention which relates to a method and apparatus for combining photographic disc processing and drying by a device in which the motor and spindle are magnetically coupled. A particular feature of the present invention is that it provides a sensing mechanism which is responsive to the decoupling of the magnetic drive system to lower the motor speed to allow recoupling.

Another salient feature of the present invention is an absorbent liner in the top of the processing chamber that functions to catch centrifugally dispersed excess processing liquid during the drying process, and does not allow such liquid to drop down on the discs being dried.

These and other objects, features and advantages will be apparent from a detailed study of the attached drawings hereinafter.

SHORT DESCRIPTION OF THE DRAWINGS

DETAILED DESCRIPTION OF THE INVENTION

Figure 1:
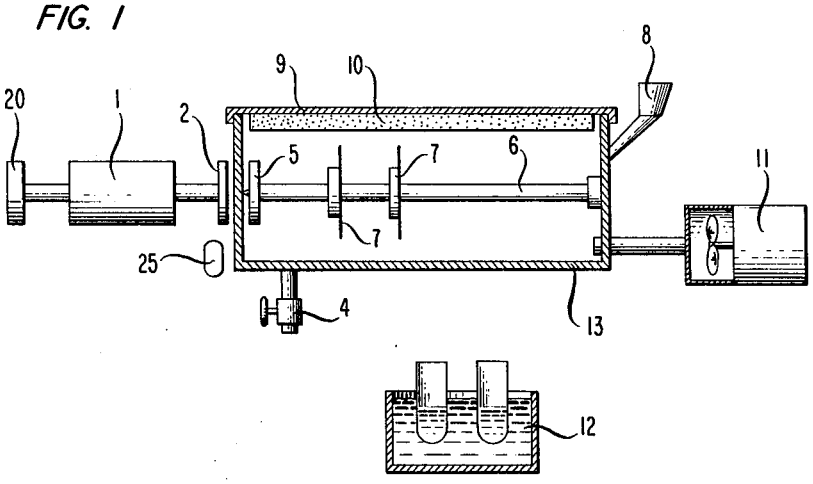
FIG. 1 is a schematic diagram showing a layout of the mechanical parts of the system.

A photographic processing tank 13 includes a spindle 6 rotatively mounted therein between bearings at opposite ends thereof. One or more photographic discs 7 are constructed to be actually mounted on the shaft or spindle 6.

A conventional servo motor 1 is connected to rotate a drive magnet 2 which is magnetically coupled to a slave magnet 5 which rotates the spindle 6 on which a plurality of photographic film discs 7 are mounted. The drive magnet 2 and slave magnet 5 are coaxially disposed round ceramic 4-pole magnets, magnetically coupled so that the north pole of one is nearest to the south pole of the other, thereby coupling them together so that if one is rotated the other will also rotate.

The processing tank 13 is filled with, say, about one quart of photo-processing liquid, such as, for example, photo developer, bleach, fix, or other processing liquids. Tank 13 is filled through the fill spout 8. During the initial process, the motor 1 constantly operates at a rotational speed of, say 200 rpm. After the required time for completing the liquid processing, tank 13 is emptied through a drain 4. For the initial and subsequent processing steps the processing liquid is maintained at a constant temperature by a bath 12 before being interposed into the tank 13 through fill spout 8.

After the liquid processing phase has been completed, and the liquid has been drained from the tank 13, the switch 22 on the timer circuit 23 is operated to initiate the drying step. This will be described in detail hereinafter with reference to the control circuit shown in FIG. 2.

As an additional feature the dryer described hereinafter can be operated to preheat chamber 13 and any enclosed discs 7 prior to introducing the heated photo-processing liquid.

The chamber 13 contains on its upper surface light-tight lid 9, which closes an opening in the top thereof thereby allowing processing in day light. In the embodiment under description the lid 9 is about 8 inches long, 5 inches wide and ½ inch thick, and has secured to its under surface an absorbent linear 10, in the present embodiment, a polyethelyene screen, 8 inches by 4 inches by a 1/16 inch thick.

At the beginning of the drying step the speed of rotation of the motor 1 is increased to 2000 rpm, rotating the drive magnet 2 which rotates the spindle 6 under control of the slave magnet 5, thereby causing the discs 7 to rotate at a speed of 2000 rpm. The discs 7 rotating at high speed centrifugally throw off excess amounts of photo-processing liquid. The absorbent liner 10 of the light-tight lid 9 catches these excess amounts of photo-processing liquid to prevent them dropping down on the discs 7 during the remainder of the drying step. After, say, 30 seconds, the motor 1 slows down to 200 rpm for the remainder of the drying cycle. About 7 minutes is required for drying by the conventional photographic disc film drying process. Also, at the beginning of the drying step a conventional heater-blower 11 is turned on to pass warm air, heated to a temperature of about 110° Fahrenheit into the chamber 13 in a direction to pass over or adjacent to the discs 7 and out of the chamber 13 through light-tight openings provided for the purpose.

Figure 2:
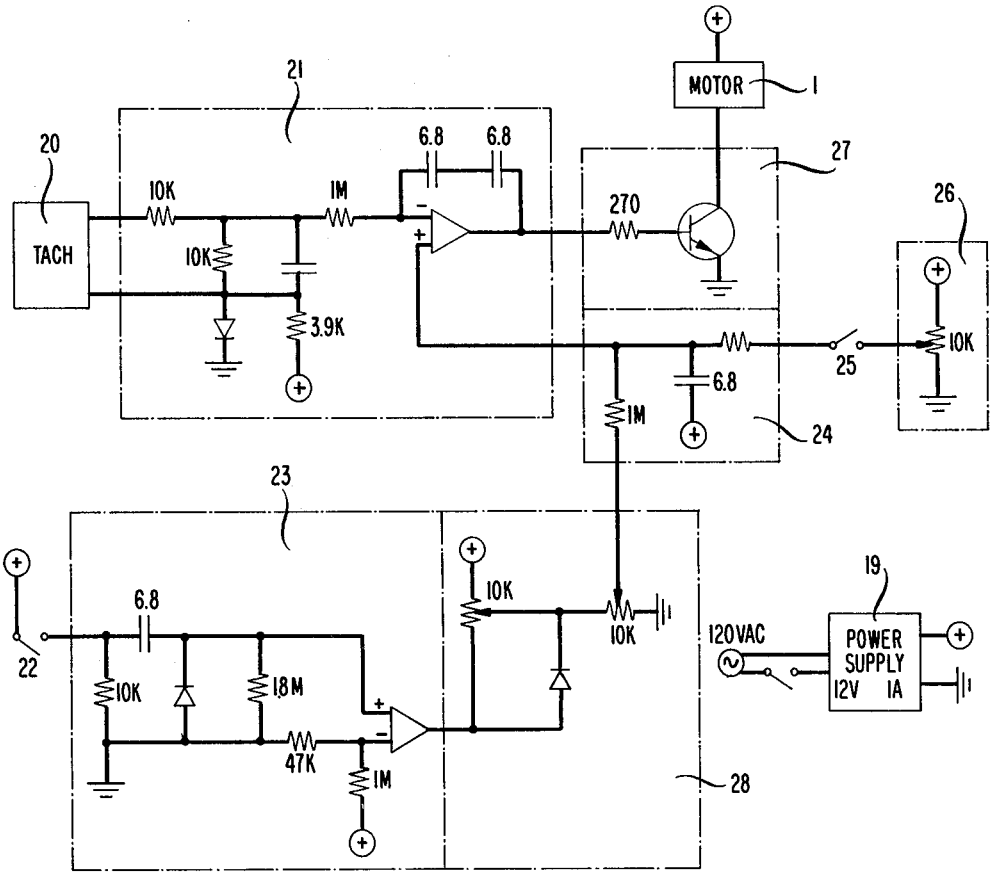
FIG. 2 is a schematic diagram for a circuit which controls operation of the motor 1 and the functioning of other elements of the circuit of FIG. 1.

The electronic controls and drive circuit, shown in FIG. 2, will now be described. This circuit is energized by a power supply 19 which is 120 volt AC, converted to 12 volt DC. A conventional tachometer 20, which is mechanically linked to the motor 1, generates a DC voltage which is fed into a conventional integrator circuit 21. In the present circuit the tachometer 20 generates between 0.5 and 12 volts DC.

The integrator circuit 21 functions to compare the output signal of the speed-set potentiometer 28. If the tachometer 20 output signal exceeds the output of potentiometer 28, it initiates operation of transistor amplifier 27 to lower the current to slow down the rpm of the motor 1. If the reverse is true, it operates to raise the current to motor 1 to increase its rotational speed.

The RC timing circuit 24 functions to impose a five second time period on the input amplifier circuit 21, thereby slowing down the system response. The drive select switch 22 triggers the conventional one-shot pulse generator 23 to select and energize the high speed potentiometer 28 to raise the voltage applied to integrator circuit 21 thereby raising the speed of rotation of the motor 1. Decoupling magnetic reed relay 25 which is connected to potentiometer 26, is operated to close by stray magnetic flux which emanates from the drive magnet 2 when the latter is decoupled from the slave magnet 5, thereby generating a low voltage signal from potentiometer 26 to the input of integrator circuit 21 thereby initiating a slow down of the motor 1, so that recoupling can occur between coupling magnets 2 and 5.

It will be understood that the present invention is not to be construed as limited by the present disclosure which is merely by way of example, but only by the scope of the appended claims.

What is claimed is:

1. An apparatus for processing and drying photographic disc film comprising in combination:

a film processing chamber constructed to accommodate a quantity of processing liquid, and having a liquid intake nozzle and a drain;

an opening in said chamber having a light- opaque closure;

a spindle interposed in said chamber for supporting and rotating at least one disc of photographic film;

a source of power including an on-off switch;

a motor constructed to drive said spindle to rotate at a first preselected speed of rotation;

magnetic coupling means;

said motor coupled by said magnetic coupling means in driving relation to said spindle through said magnetic coupling means;

a control circuit in circuit relation with said source of power for operating said motor which comprises in combination a timing circuit which is constructed to produce a timing signal to actuate said motor to shift said spindle to change the speed of rotation of said motor from said first speed of rotation to a second speed of rotation for a preselected period;

magnetic sensing means responsive upon the decoupling of said magnetic coupling means to recouple said motor in driving relation to said spindle.

2. The combination in accordance with claim 1 wherein said second preselected rotational speed is substantially higher than said first preselected speed, for creating a substantial amount of centrifugal force for throwing off excess amounts of said processing liquid from said film disc during said high speed rotation.

3. The combination in accordance with claim 1 wherein said first rotational speed is of the order of 200 revolutions per minute, and said second rotational speed is of the order of 2000 revolutions per minute.

4. The combination in accordance with claim 2 wherein said apparatus includes a source of warm gas;

means for heating said gas to a temperature substantially above ambient temperature;

means responsive to operation of said magnetic sensing means, and operative to convey a stream of said warm gas into said processing chamber in a direction to pass adjacent to the photographic disc film and to dry said film.

5. The combination in accordance with claim 4 wherein said light-opaque closure includes an inner lining of liquid absorbent material for absorbing said excess processing liquid thrown off of said disc film to prevent said liquid from dripping back onto said disc film during drying.

6. The combination in accordance with claim 5 wherein said inner lining comprises a mat of polyethelyene screen at least about 8 inches long and 4 inches wide and 1/16 inch thick secured to the inner surface of said light-opaque closure.

7. The combination in accordance with claim 4 wherein said gas comprises air heated to about 110° Fahrenheit.

* * * * *